US007147233B2

(12) United States Patent
Edmond

(10) Patent No.: US 7,147,233 B2
(45) Date of Patent: Dec. 12, 2006

(54) BINDING FOR KEEPING A BOOT ATTACHED TO A SNOWBOARD

(76) Inventor: Jean-Pierre Edmond, 14, chemin des Saules, F-74100 Annemasse (FR)

( * ) Notice: Subject to any disclaimer, the term of this patent is extended or adjusted under 35 U.S.C. 154(b) by 0 days.

(21) Appl. No.: 11/204,945

(22) Filed: Aug. 15, 2005

(65) Prior Publication Data

US 2005/0285372 A1 Dec. 29, 2005

Related U.S. Application Data

(63) Continuation of application No. PCT/EP2004/050090, filed on Feb. 5, 2004.

(30) Foreign Application Priority Data

Feb. 20, 2003 (FR) ..... 03 02118
Mar. 13, 2003 (FR) ..... 03 03205

(51) Int. Cl.
*B62B 9/04* (2006.01)

(52) U.S. Cl. ..... 280/14.22; 280/14.23; 280/624

(58) Field of Classification Search ..... 280/14.22, 280/14.23, 14.24, 616, 617, 619, 621, 624, 280/626, 622, 613
See application file for complete search history.

(56) References Cited

U.S. PATENT DOCUMENTS 5,556,123 A 9/1996 Fournier
5,692,765 A 12/1997 Laughlin
6,003,893 A * 12/1999 Hansen ..... 280/624
6,116,634 A * 9/2000 Mometti ..... 280/613
6,588,773 B1 * 7/2003 Van Riet et al. ..... 280/14.22

FOREIGN PATENT DOCUMENTS

WO WO 95/33534 12/1995

* cited by examiner

*Primary Examiner*—Hau Phan
(74) *Attorney, Agent, or Firm*—Sturm & Fix LLP

(57) ABSTRACT

A binding which is used to keep a boot connected to a snowboard, comprising a seat which is fixed to a board, a strap which is attached to the seat in order to receive a front part of the boot, a rear bearing shell for receiving a rear part of the boot and a mechanism for tightening the rear bearing shell in relation to the seat. The rear bearing shell is divided into two side panels which can pivot laterally in relation to the seat by virtue of mechanical pivots or by deformation of said side panels, and a center panel which can pivot from the front to the back in relation to the seat in order to enable the center panel to tilt towards the rear and from the back to the front in a closed position, wherein the two side panels are superposed in relation to the center panel and tightened by the tightening mechanism which acts in such a way that it prevents the center panel from tilting towards the rear in relation to the base.

9 Claims, 6 Drawing Sheets

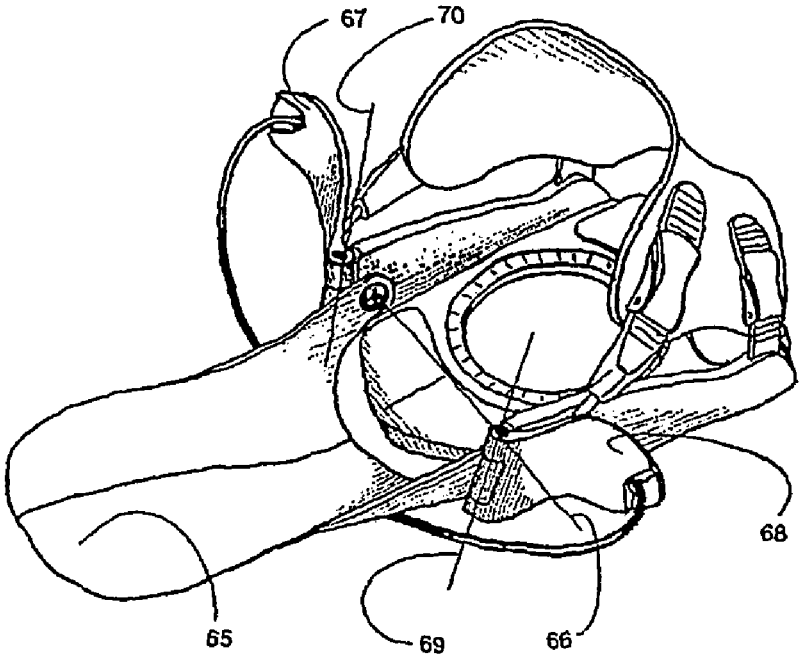
Fig. 2
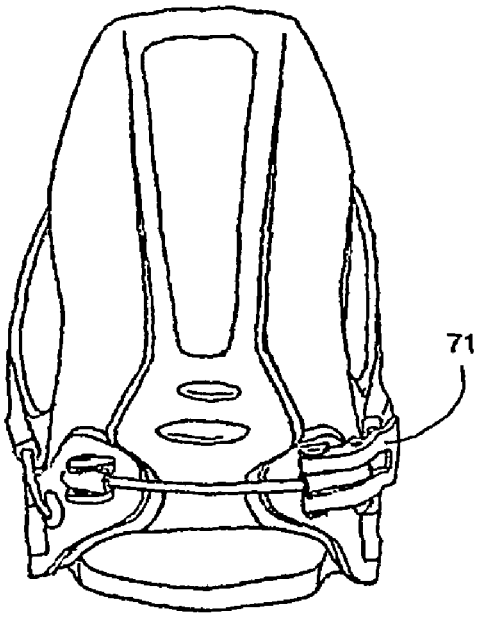
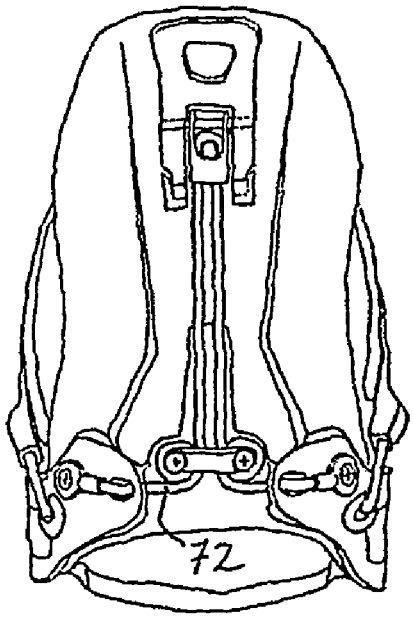
Fig. 4
Fig. 3

BINDING FOR KEEPING A BOOT ATTACHED TO A SNOWBOARD

CROSS REFERENCE TO RELATED APPLICATIONS

This application is a Continuation application of PCT/EP2004/050090 filed Feb. 5, 2004, which claims priority of Application Nos. FR03.02118 filed Feb. 20, 2003 and FR03.03205 filed Mar. 13, 2003, which are included in their entirety by reference made hereto.

BACKGROUND OF THE INVENTION

1. Field of the Invention

The present invention relates to a binding which is intended to keep a boot attached to a snowboard and into which the user inserts the boot from the rear by virtue of a device for retracting the rear bearing shell to enable the getting-in and getting-out operations.

The invention relates to such a binding comprising more particularly a baseplate to be fixed to the board, a tongue attached to the baseplate for receiving a front part of the boot, a rear bearing shell for receiving a rear part of the boot and a means for tightening the rear bearing shell in relation to the baseplate.

2. Description of the Related Art

A binding of this type is known, for example, from the document U.S. Pat. No. 5,556,123 or the document EP-A-750 625.

SUMMARY OF THE INVENTION

The object of the invention is various embodiments of a binding having a rear bearing shell with three panels and associated devices in order to provide it with all the functions necessary for its use. These devices concern the adjustment of the inclination and the folding of the rear bearing shell to adjust the binding to the user's preferences and to facilitate transportation and storage, the adjustment of the tightening of the tongue realised by virtue of a flexible link and the automatic control of the tightening of the tongue by the movement of the rear bearing shell in order to tighten it during the closure of the rear bearing shell and slacken it during the opening so as to facilitate the getting-in and getting-out.

To that end, the invention relates to a binding for keeping a boot attached to a snowboard, comprising a baseplate to be fixed to the board, a tongue attached to the baseplate for receiving a front part of the boot, a rear bearing shell for receiving a rear part of the boot and a means for tightening the rear bearing shell in relation to the baseplate, characterised in that the rear bearing shell comprises two side panels which pivot in relation to the baseplate by virtue of mechanical pivots or by deformation of the side panels themselves, and a centre panel which pivots from the front to the back in relation to the baseplate in order to open into an open position where the two side panels have pivoted in order to enable the centre panel to tilt towards the rear and in order to close again into a closed position where the two side panels are superposed in relation to the centre panel and tightened by the tightening means which acts to oppose the tilting of the centre panel towards the rear in relation to the baseplate.

In a particular embodiment of the invention, the side panels and the centre panel are borne by an interface guided rotationally from the front to the back in relation to the baseplate. Advantageously, at least one means for traction of the tongue is fixed to at least one of the side panels by a connection of the swivel type to cause respectively a loosening or tightening of the tongue during the pivoting of the two side panels respectively into the open position or into the closed position.

Other advantages of the invention will become apparent in the light of the description of the embodiments illustrated by the drawings.

BRIEF DESCRIPTION OF THE DRAWINGS

FIG. 2 illustrates the binding drawn in FIG. 1, the rear bearing shell being in an open position.

FIG. 3 is a rear view of the binding illustrated in FIG. 1, showing more particularly a first type of tightening means.

FIG. 4 is a rear view of the binding illustrated in FIG. 1, showing more particularly a second type of tightening means.

DETAILED DESCRIPTION OF THE PREFERRED EMBODIMENTS

Figure 1:
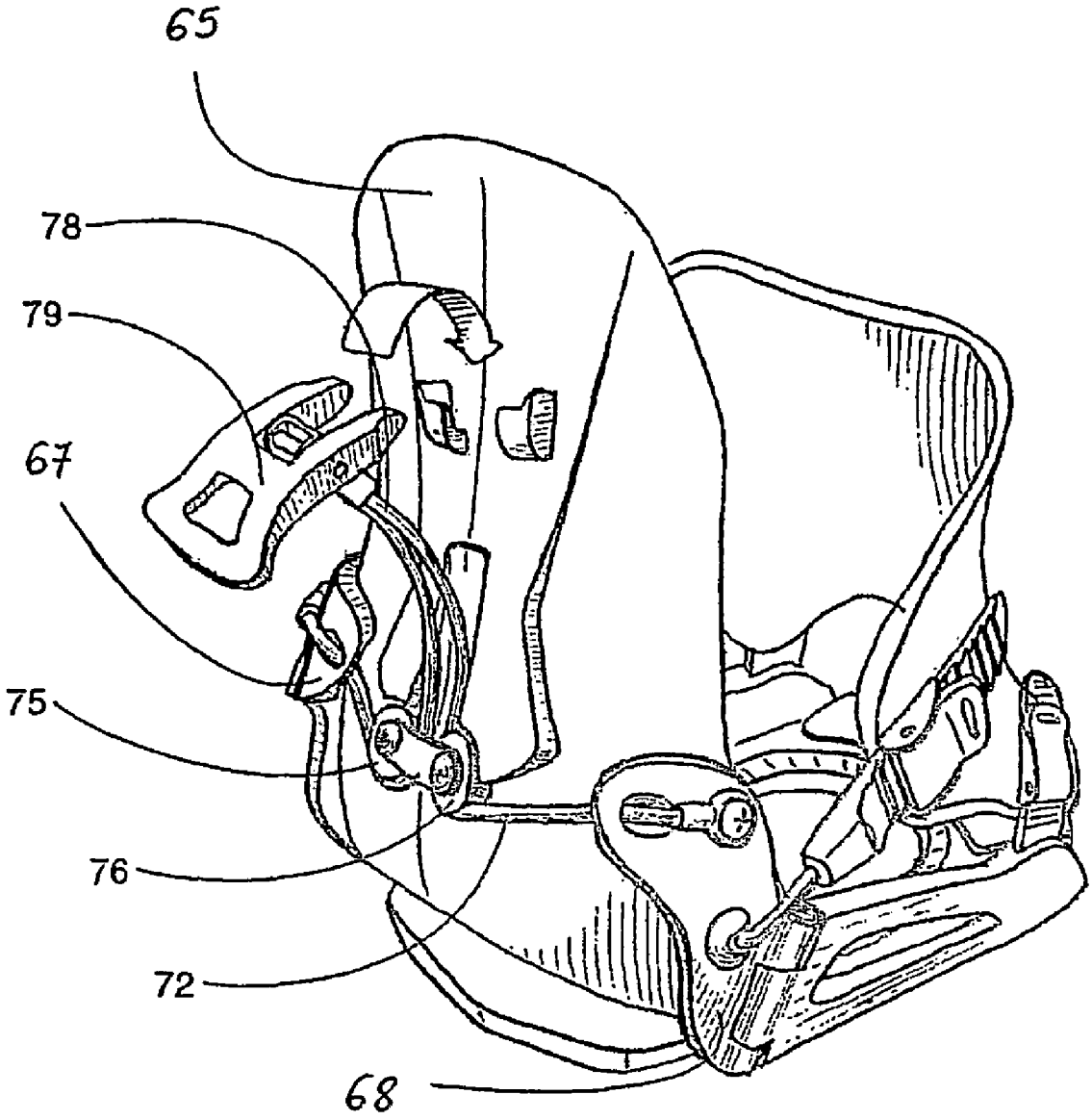
FIG. 1 is a perspective view of a binding according to a first embodiment of the invention, the rear bearing shell being in a closed position.
Figure 5:
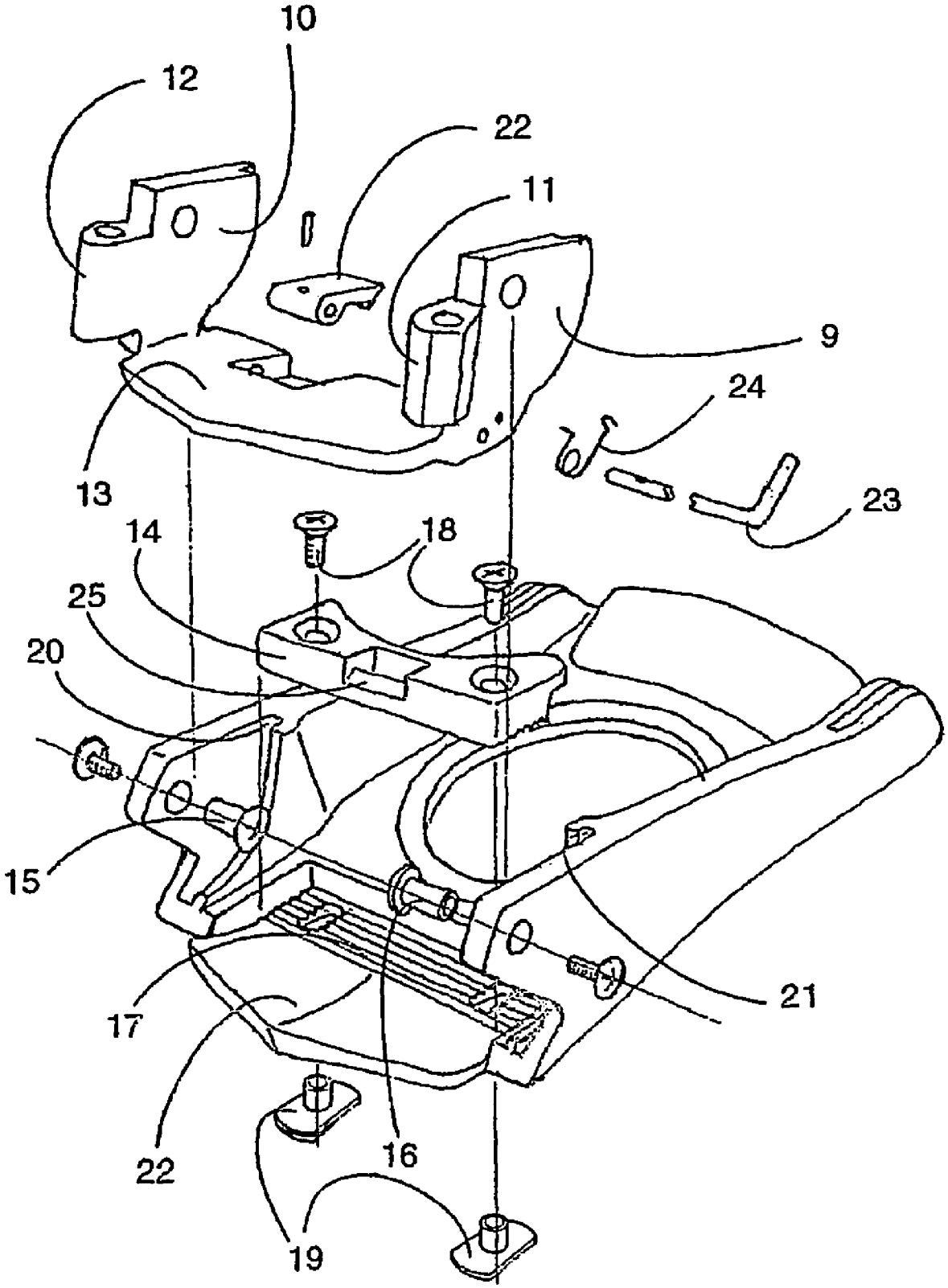
FIG. 5 is an exploded view of a binding according to a particular embodiment of the invention in which an interface bearing the side and centre panels is guided rotationally in relation to the baseplate.

A binding for keeping a boot attached to a snowboard comprises, as shown in FIGS. 1 to 4, a baseplate 1 to be fixed to the snowboard, an adjustable tongue 2 for receiving a front part of the boot and a rear bearing shell for receiving a rear part of the boot.

According to the invention, the rear bearing shell comprises two panels 67 and 68 articulated on each side of the baseplate 1 on the axes 69 and 70 and a panel 65 articulated on an axis 66, perpendicular to the longitudinal axis L of the baseplate, placed on the baseplate.

In order to open the binding, the panels 67 and 68 are opened laterally, which enables the panel 65 to tilt towards the rear. During the closure, after the boot has been introduced into the tongue, the panel 65 is pivoted towards the front until it comes into contact with the rear part of the boot. Next, the two panels 67 and 68, by their lateral closing movement, are superposed on the panel 65 while grasping it, and are then brought closer together and held by a tightening means which acts between them while blocking the rotation of the panel 65 towards the rear.

There are numerous possibilities for dividing a rear bearing shell into three panels, by fitting into or overlapping one another. For example, the three panels 65, 67 and 68 can fit into one another in the use position, so as to stiffen the rear bearing shell. The panels 67 and 68 can also be locally superposed on the panel 65 and be in direct contact with the boot at other locations. In this embodiment, the two panels 67 and 68 can also be movable in a laterally opening movement by deformation of the material(s) of which they are composed.

During the tightening phase, between the time when the panels 67 and 68 are superposed on the panel 65 and the time when they are brought closer together and held in their use position, there occurs a combined movement between a pivoting of the panels 67 and 68 towards the inside caused by the user and a simultaneous pivoting of the panel 65 towards the front caused by the panels 67 and 68 which bear on it while exerting a torque towards the front. In this embodiment, the angular adjustment of the rear bearing shell from the front to the back is obtained by the adjustment of the closed position of the panels 67 and 68 to a greater or lesser degree of proximity. Thus, when they are at the maximum proximity of the adjustment, the panel 65 is pivoted to the maximum towards the front and when they are at the maximum separation of the adjustment, the panel 65 is pivoted to the maximum towards the rear by virtue of the effect of the combined movements of the three panels. The adjustment is caused by the variation of the distance between the fastenings of the tightening means on the panels 67 and 68 or by modification of the length of elements constituting the tightening means.

The tightening means 71 can act directly between the panels 67 and 68. As illustrated in FIG. 4, the tightening means is engaged on each of the two side panels and acts between them to tighten them and hold them in the closed position or can also be connected to the panel 65 as shown in FIG. 3 in order to enable the simultaneous closing movements of the three panels. Thus, in the embodiment illustrated in FIGS. 1 and 3, a flexible link 72 fixed to each of the panels 67 and 68 is guided on the panel 65 through loops 75 and 76, which may be pulleys. The horizontal movement of the link 72 before the loops 75 and 76 is converted into a vertical movement thereafter. Thus, the strands 78 of the link 72 can be pulled from the bottom upwards directly by the user or via a tightening means 79, in order to cause the simultaneous closure of the three panels without other manual interventions. The tightening means must enable the strand 78 to unwind in the loops over a length sufficient to enable sufficient spreading of the panels 67 and 68 and sufficient opening of the rear bearing shell.

According to a particular embodiment of the invention, the device for adjusting the inclination and folding of the rear bearing shell is composed, as shown in FIGS. 5 to 8, of an interface 7 guided rotationally in relation to the baseplate 1 on an axis perpendicular to the longitudinal axis of the binding and bearing the articulations of the two panels 67 and 68 of the rear bearing shell. The panel 65 can be articulated directly on the baseplate or on the interface 7 which bears the panels 67 and 68 for lateral opening and which will ensure, in this embodiment, the angular adjustment of the rear bearing shell from the front to the back.

Thus, the subassembly formed by the rear bearing shell and the interface is movable rotationally from the front to the back in relation to the baseplate. In this embodiment, the adjustment of the angular use position of the panel 65 can be obtained by virtue of the interface which bears the two panels 68 and 69 which will be oriented from the front to the back according to the user's wishes. In particular, the axis of rotation of the panel 65 can be coincident with the axis of rotation of the interface.

The interface is composed of the two sectors 9 and 10, arranged vertically on each side and guided rotationally in the baseplate by the pins 15 and 16, which bear the two panels of the rear bearing shell by way of the journals 11 and 12. The two sectors 9 and 10 can be connected by a zone 13 situated under the heel of the boot in the use position and thus constitute a form of stirrup, so that the two panels of the rear bearing shell are always in corresponding positions.

The interface may be of one piece or be formed of an assembly of elements. For example, the journals 11 and 12 may be pieces fixed to the sectors 9 and 10 or to the zone 13 to enable the use of a different material at the articulation such as a metal section or stamped piece of sheet metal in order to improve the strength compared with a plastic piece. The journals 11 and 12 may also be a composite of a plurality of materials, for example a metalloplastic composite. The rotation of the interface towards the rear can be arrested by a stop 14 adjustable to enable the user to choose the suitable inclination of the rear bearing shell. The adjustment is produced by the displacement of the stop from the front to the back in a step corresponding to toothing 17 of the baseplate. The stop 14 is held in the chosen position by virtue of an appropriate tightening means, for example bolts 18 and nuts 19.

The interface 7 can be guided and supported in the use position by grooves 20, 21 and by the cylindrical zone 22 in order to improve the rigidity of its connection to the baseplate and relieve the pins 15 and 16. The zone 22 on which the interface comes to bear is more specifically intended to take part in absorbing the vertical forces. However, in another embodiment, this zone can disappear and in this case the zone 13 of the interface extended downwards can come directly into contact with the board by virtue of carefully chosen forms.

The interface 7 is locked in the use position by a retractable retaining means. This means may be a lever 22 embedded in the zone 13 of the interface, which lever is fixed to the pin 23 articulated in the interface and returned by a spring 24. The lever has a tooth which cooperates with a corresponding shape 25 of the stop to hold the interface in the use position. The tooth can be disengaged from its embedding in the stop by the intervention of the user on the pin 23 to pivot the locking lever and release the connection between the interface and the stop. The locking lever may also be articulated in the stop and catch on the interface.

Figure 6:
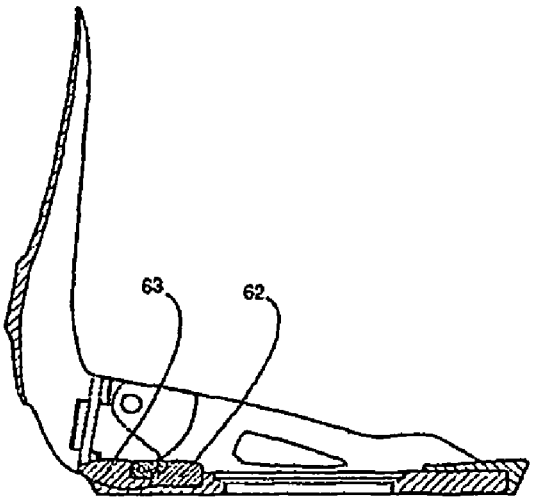
FIG. 6 shows the binding illustrated in FIG. 5, in a first, least-bent adjustment position of the interface, the centre panel being in the closed position.
Figure 7:
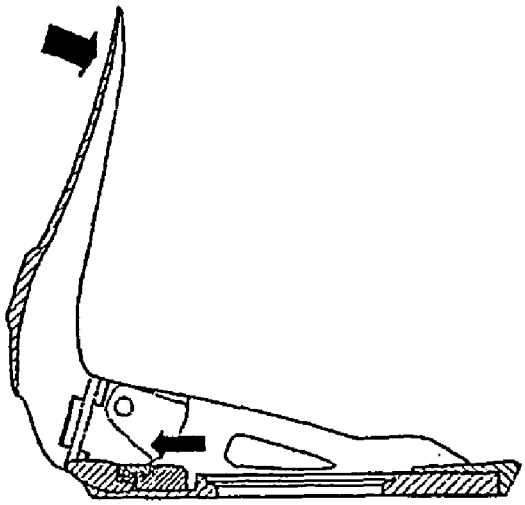
FIG. 7 shows the binding illustrated in FIG. 5, in a second adjustment position of the interface, the centre panel likewise being in the closed position.
Figure 8:
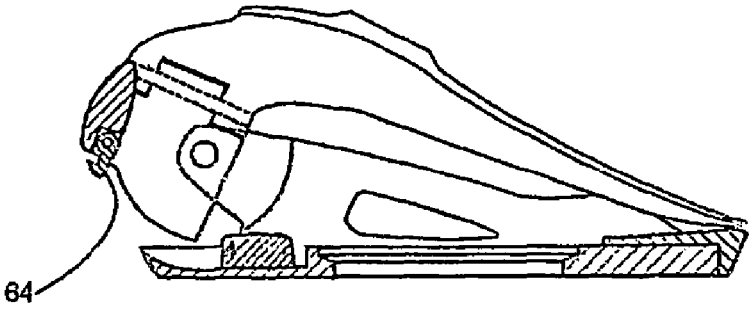
FIG. 8 shows the binding illustrated in FIG. 7, in a transporting position, in which the centre panel is bearing on the baseplate, the binding tongue having been removed.

FIG. 6 shows the inclination device in the least-bent position and FIG. 7 shows the displacement of the stop 14 towards the rear and the corresponding inclination of the rear bearing shell. The rotation of the interface towards the front is free in order to enable the rear bearing shell to pivot until it comes into contact with the baseplate when the tongue is detached from the binding, according to FIG. 8. The tongue can be remounted on the binding thus folded so as to constitute a compact assembly, the elements of which are protected for transportation or storage.

The zone 13 of the interface is situated under the heel of the boot which can rest directly on top. Thus, the heel is slightly raised when the rear bearing shell is adjusted by being pivoted towards the front: this property of the device facilitates the corresponding bending of the boot and provides the user with a more comfortable position and better balance. However, the zone 13 of the interface may be covered by a zone of the baseplate or a zone connected to the stop 14 and not be directly in contact with the heel of the boot. In another embodiment, the zone 13 may be eliminated, in which case the sectors 9 and 10 are independent but can be arrested when rotating towards the rear by the stop 14 which is common to them, by coming up against it.

In another embodiment, such as for example for the front part of a ski boot upper cuff, the side panels 67 and 68 of the rear bearing shell may be free from articulations of the mechanical type and open by virtue of the deformation of the material(s) of which they are composed, it being possible for this deformation to be localised or more general. In this case, the side panels 67 and 68 of the rear bearing shell are fixed rigidly to the interface 7 or may form with the interface a single piece which will comprise zones of greater or lesser flexibility by virtue of the carefully chosen differences in thickness or by virtue of the imbrications of materials at the carefully chosen flexibility. In this case, the opening movement becomes difficult to describe precisely, but it will retain its laterally opening movement characteristic.

In what follows and for reasons of clarity, the description will relate essentially to the embodiments having an articulation of the mechanical type, but the lateral opening by deformation is an embodiment compatible with all the embodiments described in this document.

The user of the rear-entry binding according to the invention may encounter difficulties, when getting in, as regards introducing the boot deeply enough into the tongue, and in this case it is more difficult to close the rear bearing shell again. The device for automatic control of the tightening of the tongue described below has the purpose of slackening the tongue during the opening and tightening it during the closure of the rear bearing shell.

Figure 9:
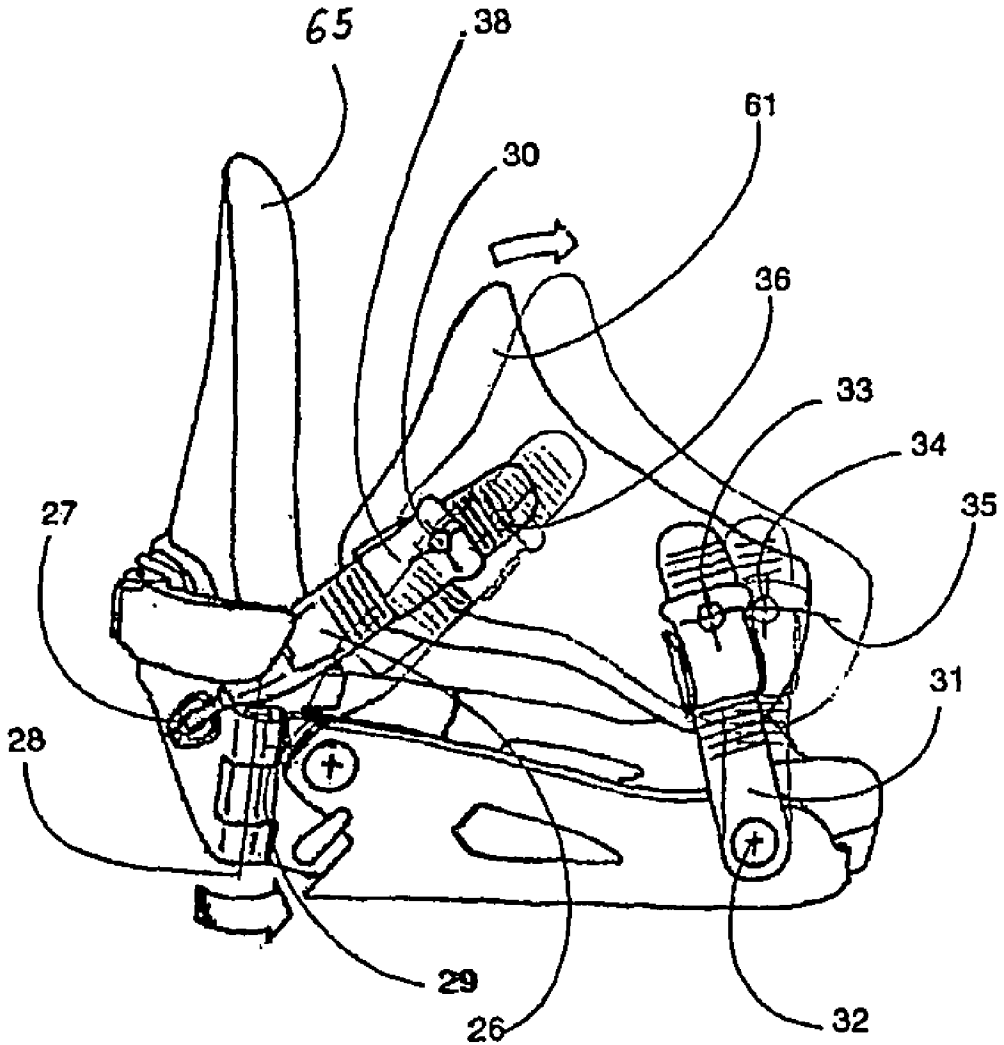
FIG. 9 is a side view of the binding illustrated in FIGS. 1 and 2, showing more particularly automatic control of the tongue by the side panels.

As illustrated in FIG. 9, four straps 26 and 31 tighten the tongue on the front part of the boot while being movable in relation to the baseplate 1 such that during the opening of the two panels 67 and 68 of the rear bearing shell, the tongue 2 is displaced towards the front and upwards.

A rear strap 26, adjustable at one of its ends in relation to the tongue 2 by virtue of an appropriate means 38, is fixed to the tongue so as to be able to pivot about the point 30. The rear strap 26 is fixed at its other end to a side panel 67 or 68 of the rear bearing shell by a connection of the swivel type centred at a point 27. This point is placed on the side panel to describe a portion of a circle about the articulation axis 28 of the side panel, so as to be displaced towards the front during the opening of the rear bearing shell. The movement thus produced tends to push the tongue towards the front.

A front strap 31 is articulated at one of its ends in relation to the baseplate at a point 32 and fixed to the tongue at its other end by an adjustable fastening means 38 which can pivot about the point 33 to enable the tongue to advance and lift when the rear bearing shell is opened. Thus, on opening, the point 27 passes to the point 29, the rear strap 26 pushes the tongue towards the front and the point 33 passes to the point 34 while moving over a portion of a circle 35 centred at the point 32, while at the same time the point 30 has moved to the point 36.

In order to obtain maximum slackening of the tongue at the front strap 31, the position of an axis passing through the points 34 and 32, at the time of maximum opening of the rear bearing shell, must be close to the vertical. A stop arresting the rotation of the front strap 31 towards the front on the baseplate can be provided in order to fix this position. In this case, after the front strap has reached the stop, the rear strap 26 absorbs the opening travel of the rear bearing shell by rotation about the point 30 which moves upwards as far as the point 36 while lifting the rear of the tongue which then pivots about the point 34, fixed in relation to the baseplate during this phase.

In another embodiment, the rotation of the straps in relation to the tongue may be the result of an elastic deformation of parts of the tongue or straps. The rotational travel of the rear strap 26 in relation to the tongue can be limited in both directions by a suitable means, in order to guarantee the end positions of the tongue. In particular, it can be fixed rigidly to the tongue: in this case, the front strap must have a sufficient rotational travel from the front to the back to absorb the entire travel imposed by the rear strap which can no longer pivot in relation to the tongue about the point 30.

The rear strap 26 has been described as acting directly on the tongue, but it may act via a device fixed to the baseplate or to the interface which converts the rotational movement about the axis 28 of the end 27 of the rear strap 26 into a movement oriented to cause the tightening or loosening of the tongue. For example, the rear strap 26 may be replaced by a flexible link which can be guided through a loop fixed to the interface or to the baseplate. Similarly, an element fixed at one of its ends to the side panel by a connection of the swivel type may act on the front part of the tongue directly or via a device chosen with the aim of increasing the tightening or loosening travel on the front part of the tongue. For example, a flexible link may be fixed at one end to the side panel, be guided through a loop fixed to the baseplate and act at its other end on the front of the tongue by pulling it downwards during tightening.

The connection of the swivel type mentioned in this paragraph may be realised either by a mechanical device or by deformation of a flexible material. The device for automatic control of the tightening of the tongue by the movement of the rear bearing shell is described in this paragraph for a single side of a binding but may be applied to both sides symmetrically.

The device for automatic control of the tightening of the tongue described in the preceding paragraph may cooperate with an adjusting system so that the user can adjust the tightening tension.

Figure 10:
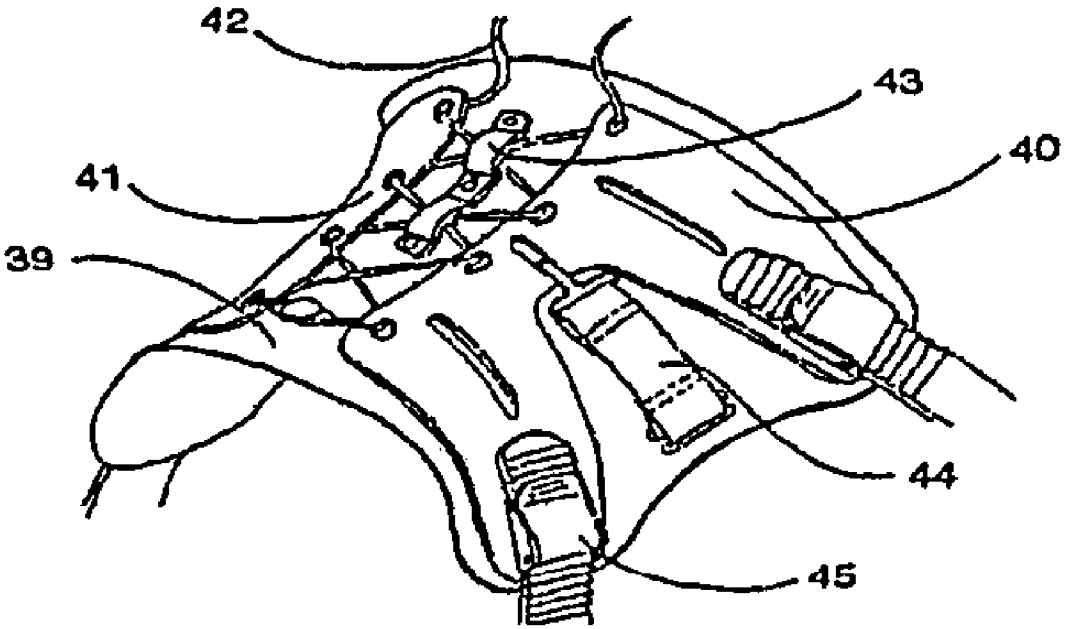
FIG. 10 shows the tongue of the binding illustrated in FIGS. 1 and 2, provided with means for adjusting the tightening tension.

For this purpose, recourse is had to a flexible link of the lace type for effecting the adjustment. A covering 39, as shown in FIG. 10, of greater or lesser flexibility, is provided to be in direct contact with the front part of the boot. This covering is lashed by two flexible wings 40 and 41 which are fixed by an appropriate means 45 to the straps on one side and brought closer together by a link 42 at the centre. Thus, when the user exerts traction on the link, the two wings slide on the covering while coming closer together at the centre, and the covering is pressed against the boot so as to ensure the desired tightening tension.

Each of the wings may be separated into two pieces, each fixed to a strap with a view to obtaining greater tightening independence between the front and the rear of the tongue. The wings and the straps may thus constitute one and the same piece.

To ensure the cohesion of the assembly, the covering has loops which maintain its contact with the wings and the symmetry of their positions, while enabling the free sliding between the covering and the wings. To that end, the covering has, for example, lace guides 43 at the centre and a double wall which is made of a flexible material and into which the wings are introduced. In order to maintain the tension in the link 42 and take part in the pressing of the wings against the covering, an elastic link 44 exerts traction between the covering and the wings. The fixing of the wings to the straps is adjustable in order to increase the range of boot sizes usable in the binding.

It should be noted that the binding according to the invention applies not only to a snowboard but also to a snowshoe or alpine skis.

The invention claimed is:

1. Binding for keeping a boot attached to a snowboard, comprising a baseplate to be fixed to the board, a tongue attached to the baseplate for receiving a front part of the boot, a rear bearing shell for receiving a rear part of the boot and means for tightening the rear bearing shell in relation to the baseplate, wherein the rear bearing shell is divided into two side panels and a central panel, said side panels pivoting laterally in relation to the baseplate by virtue of mechanical pivots or by deformation of the side panels themselves, and said centre panel pivoting from the front to the back in relation to the baseplate into an open position, where the two side panels have pivoted in order to enable the centre panel to tilt towards the rear, and from the back to the front into a closed position, where the two side panels are superposed in relation to the centre panel and tightened by the tightening means which acts to oppose the tilting of the centre panel towards the rear in relation to the baseplate.

2. Binding for keeping a boot attached to a snowboard according to claim 1, wherein the tightening means is engaged on each of the two side panels and acts between them to tighten them and hold them in the closed position.

3. Binding for keeping a boot attached to a snowboard according to claim 1, wherein the tightening means comprises a flexible link fixed to the two side panels and is guided through at least one loop fixed to the centre panel to cause the joint closure of the centre panel and the side panels by traction on a strand of the link situated after the loop.

4. Binding for keeping a boot attached to a snowboard according to claim 1, wherein the side panels are articulated or fixed on an interface guided rotationally from the front to the back in relation to the baseplate.

5. Binding for keeping a boot attached to a snowboard according to claim 4, wherein the interface comprises at least two sectors and connected by a crossmember.

6. Binding for keeping a boot attached to a snowboard according to claim 5, wherein the interface comes into contact with a stop at a point of rotation of the interface towards the rear and in that a releasable retaining means acts between the stop and the interface to block the rotation of the interface towards the front.

7. Binding for keeping a boot attached to a snowboard according to claim 1, wherein at least one means for traction of the tongue is articulated to at least one of the side panels to cause respectively a loosening or tightening of the tongue during the pivoting of the two side panels respectively into the open position or into the closed position.

8. Binding for keeping a boot attached to a snowboard according to claim 7, wherein the means for traction of the tongue is articulated to the side panel for a connection of the swivel type.

9. Binding for keeping a boot attached to a snowboard according to claim 1, wherein the tongue has a covering on which means for traction of the tongue slide when they are brought closer together by a flexible link for adjusting a tightening tension of the tongue, an elastic link exerting traction between the covering and the traction means.

* * * * *